US009373886B2

(12) United States Patent
Kitchener

(10) Patent No.: US 9,373,886 B2
(45) Date of Patent: Jun. 21, 2016

(54) APERTURE COUPLED RADIATOR AND ANTENNA INCLUDING THE SAME

(75) Inventor: Dean Kitchener, Essex (GB)

(73) Assignee: Ace Technologies Corporation, Incheon (KR)

( * ) Notice: Subject to any disclaimer, the term of this patent is extended or adjusted under 35 U.S.C. 154(b) by 289 days.

(21) Appl. No.: 14/117,357

(22) PCT Filed: May 18, 2011

(86) PCT No.: PCT/KR2011/003667

§ 371 (c)(1),
(2), (4) Date: Nov. 12, 2013

(87) PCT Pub. No.: WO2012/157796

PCT Pub. Date: Nov. 22, 2012

(65) Prior Publication Data

US 2014/0218254 A1 Aug. 7, 2014

(51) Int. Cl.

| | |
|---|---|
| ***H01Q 19/10*** | (2006.01) |
| ***H01Q 1/50*** | (2006.01) |
| ***H01Q 9/16*** | (2006.01) |

(52) U.S. Cl.

CPC . *H01Q 1/50* (2013.01); *H01Q 9/16* (2013.01); *H01Q 19/108* (2013.01)

(58) Field of Classification Search

CPC ..... H01Q 9/16; H01Q 1/50
USPC ..... 343/834, 844, 795–800
See application file for complete search history.

(56) References Cited

U.S. PATENT DOCUMENTS

| | | | | |
|---|---|---|---|---|
| 7,405,710 | B2 * | 7/2008 | Bisiules | H01P 5/103 343/797 |
| 2007/0205952 | A1 * | 9/2007 | Deng | H01Q 1/246 343/795 |
| 2007/0210976 | A1 | 9/2007 | Luk | |
| 2008/0309568 | A1 | 12/2008 | Deng et al. | |
| 2009/0015498 | A1 * | 1/2009 | Deng | H01Q 1/246 343/757 |

FOREIGN PATENT DOCUMENTS

EP 1231671 B1 4/2006

OTHER PUBLICATIONS

International Search Report, Aug. 30, 2011, for PCT/KR2011/003667 (with English Translation).

* cited by examiner

*Primary Examiner* — Hoanganh Le
(74) *Attorney, Agent, or Firm* — TechLaw LLP

(57) ABSTRACT

A radiator in which power is fed through a slot of a reflection plate and which can be manufactured in a simple manner and an antenna including the same are disclosed. The antenna includes a reflection plate and a radiator. The radiator includes feed sections disposed on a first surface of the reflection plate, first and second radiation elements extending perpendicular to the feed section or inclined towards the reflection plate, and first and second base plates configured to support the balanced parallel strip feed sections. Here, the first and second base plates are capacitively coupled to the reflection plate.

22 Claims, 9 Drawing Sheets

(A)

(B)

APERTURE COUPLED RADIATOR AND ANTENNA INCLUDING THE SAME

TECHNICAL FIELD

Example embodiments of the present invention relate to an aperture coupled radiator and an antenna including the same, and more particularly relate to a radiator to which a power is fed through a slot (aperture) of a reflection plate for simple manufacture and an antenna including the same.

BACKGROUND ART

An antenna, especially an antenna for a base station, includes a plurality of radiators, and transmits/receives a signal by using a beam outputted from the radiators. Generally, the radiators are connected directly to a reflection plate which functions as a ground, and so a passive intermodulation distortion (PIMD) due to contact of metals may occur.

In addition, since a feed line for feeding the power to the radiator is physically connected to a balun section of the radiator through soldering, the radiator may need to be coated with a certain substance (e.g. tinning) so as to perform the soldering. As a result, the manufacturing cost of the radiator is increased.

The above information disclosed in this Related Art section is only for enhancement of understanding of the background of the invention and therefore it may contain information that does not form the prior art that is already known in this country to a person of ordinary skill in the art.

DISCLOSURE

Technical Problem

Accordingly, the present invention is provided to substantially obviate one or more problems due to limitations and disadvantages of the related art.

An example embodiment of the present invention provides a radiator requiring no physical connection between the radiator and the reflection plate or the feed and the reflection plate, thus eliminating any potential PIM problems. In addition, the radiator design is such that it can be cut from a single planar sheet of metal (e.g. aluminum), and bent to shape allowing for very low cost of manufacture.

Technical Solution

In one aspect, the present invention provides an antenna comprising: a reflection plate, a dipole radiator, and a microstrip feed track. The dipole feed consists of two parallel strips of metal, perpendicular to the reflection plate and located on opposite sides of a slot cut into the reflection plate. The parallel strips are connected to base plates that are parallel to, but closely spaced from, the reflection plate. Each parallel strip is directly connected to a dipole arm, where the dipole arms are in the same plane as the parallel feed strips, but at ninety degrees to them.

A microstrip feed track is on the opposite side of the reflection plate. This extends up to the slot, and crosses the slot across its narrow dimension at the centre. The feed track extends beyond the slot by approximately λ/4 terminating in an open circuit. This λ/4 extension represents a matching stub whose length can be adjusted to maximize the coupling through the slot from the feed track to the dipole feed.

An air layer exists between the parallel strip dipole feed section, and an air layer exists between the base plates and the reflection plate. An air layer also exists between the microstrip feed track and the reflection plate.

The dipole arms, dipole feed strips, and the base plates are all rectangular in shape.

The base plate, dipole strip feed, and dipole arm are made from a single piece of metal, requiring a single bend for the base plate.

In another aspect, the present invention provides an antenna comprising; a reflection plate, a dipole radiator, and a microstrip feed track. The dipole feed consists of two parallel strips of metal, perpendicular to the reflection plate and located on opposite sides of a slot cut into the reflection plate. The parallel plates are connected to base plates that are parallel to, but closely spaced from, the reflection plate. Each parallel strip is directly connected to a dipole arm, where the dipole arms are in the same plane as the parallel feed strips, but at ninety degrees to them. At the junction of the feed strip and the dipole arm, the corner is chamfered to assist with the impedance matching of the dipole.

A microstrip feed track is on the opposite side of the reflection plate. This extends up to the slot, and crosses the slot across its narrow dimension at the centre. The feed track extends beyond the slot by approximately λ/4 terminating in an open circuit. This λ/4 extension represents a matching stub whose length can be adjusted to maximize the coupling through the slot from the feed track to the dipole feed.

A first dielectric layer exists between the parallel feed strips for the dipole, a second dielectric layer exists between the base plates and the reflection plate, and a third dielectric layer exists within the slot in the reflection plate.

The dipole arms, dipole feed strips, and the base plates are all rectangular in shape.

The base plate, dipole strip feed, and dipole arm are made from a single piece of metal, requiring a single bend for the base plate.

In another aspect, the present invention provides an antenna comprising; a reflection plate, a dipole radiator, and a microstrip feed track. The dipole feed consists of two parallel strips of metal, perpendicular to the reflection plate and located on opposite sides of a slot cut into the reflection plate. The parallel plates are connected to base plates that are parallel to, but closely spaced from, the reflection plate. Each parallel strip is directly connected to a dipole arm, where the dipole arms are bent such that the broad surface of the arm is parallel to the reflection plate. The arms can be bent beyond the plane where they are parallel to the reflection plate, such that they are slightly inclined towards the reflection plate. This assists with the impedance matching for the dipole.

A microstrip feed track is on the opposite side of the reflection plate. This extends up to the slot, and crosses the slot across its narrow dimension at the centre. The feed track extends beyond the slot by approximately λ/4 terminating in an open circuit. This λ/4 extension represents a matching stub whose length can be adjusted to maximize the coupling through the slot from the feed track to the dipole feed.

A first dielectric layer exists between the parallel feed strips for the dipole, a second dielectric layer exists between the base plates and the reflection plate, and a third dielectric layer exists within the slot in the reflection plate.

The dipole arms are tapered (butterfly dipole), such that the width is narrowest at the feed end and widest at the extremity of the arm. The parallel feed strips are also tapered, being widest near to the reflection plate and narrowest at the dipole arms. The base plates are also tapered, where these are narrowest at the dipole feed strips, and widest at the end of the base plate furthest from the feed strips.

The base plate, dipole strip feed, and dipole arm are made from a single piece of metal, requiring a bend at the junction of the feed strip with the base plate, and a bend at the junction of the dipole arm with the feed strip.

Advantageous Effects

A radiator of the present invention is not physically connected to a reflection plate or a feed track, and thus the possibility of PIMD is removed and the manufacturing cost of the radiator may be reduced. Accordingly, the yield of the antenna may be enhanced and the manufacturing cost of an antenna may be reduced.

In addition, since there is no soldering performed when manufacturing the radiator, no coating is required on the radiator. Hence, the manufacturing cost of the radiator may be reduced.

Furthermore, a base plate, feed section and a radiation element is manufactured through a simple method of bending a single piece of metal, and thus the time and cost required for manufacturing the radiator may be reduced.

BRIEF DESCRIPTION OF DRAWINGS

Example embodiments of the present invention will become more apparent by describing in detail example embodiments of the present invention with reference to the accompanying drawings, in which.

| | |
|---|---|
| 100: reflection plate | 102: radiator |
| 104: feed track | 110, 112: feed section |
| 114, 116: radiation element | 118, 120: base plate |
| 130: slot | 142: matching stub |
| 700: reflection plate | 702: radiator |
| 704: feed track | 710, 712: feed section |
| 714, 716: radiation element | 718, 720: base plate |
| 730: slot | 734: supporting section |
| 1000: reflection plate | 1002: radiator |
| 1010, 1012: feed section | 1014, 1016: radiation element |
| 1018, 1020: base plate | 1030: slot |

-continued

| | |
|---|---|
| 1034: supporting section | 1032, 1040: dielectric layer |
| 1300: reflection plate | 1302: radiator |
| 1310, 1312: feed section | 1314, 1316: radiation element |
| 1318, 1320: base plate | 1330: slot |
| 1334: supporting section | 1332, 1340: dielectric layer |

DETAILED DESCRIPTION

Hereinafter, embodiments of the present invention will be described in detail with reference to accompanying drawings.

Figure 1:
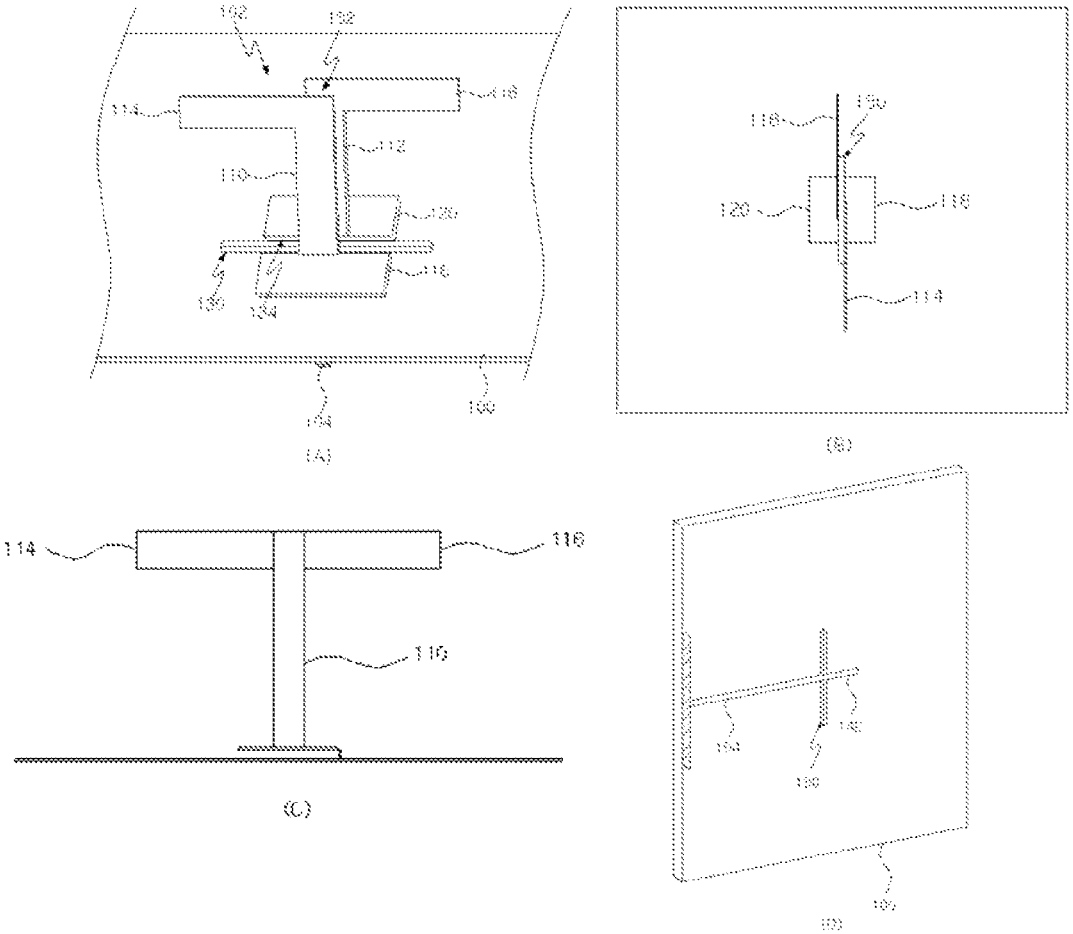
FIG. 1 is a perspective view illustrating an antenna according to a first embodiment of the present invention.

FIG. 1 is a perspective view illustrating an antenna according to a first embodiment of the present invention.

In FIG. 1(A), an antenna of the present embodiment is for example an antenna for a base station, and includes a reflection plate 100, a radiator 102 and a feed track 104. Only one radiator 102 is shown in FIG. 1, but plural radiators may be disposed on the reflection plate 100. Hereinafter, it will be assumed that one radiator 102 is disposed on the reflection plate 100 for convenience of description.

The reflection plate 100 functions as a reflector and a ground. In one embodiment of the present invention, a slot 130 as one example of an aperture is formed on the reflection plate 100 as shown in FIG. 1(A) and FIG. 1(B). Here, the slot 130 may have various shapes such as a rectangular shape, etc. The length and width of the slot 130 may be varied to optimize the coupling between the feed track and the radiator feed and for impedance matching.

The radiator 102 is disposed on the reflection plate 100, and outputs a certain radiation pattern.

In one embodiment of the present invention, the radiator 102 is a low-cost radiator having a simple structure, and includes a first feed section 110, a second feed section 112, a first radiation element 114, a second radiation element 116, a first base plate 118 and a second base plate 120.

The first feed section 110 feeds a power supplied from the feed track 104 to the first radiation element 114 by way of coupling, and may be for example a piece of metal as shown in FIG. 1(A).

The second feed section 112 feeds the power supplied from the feed track 104 to the second radiation element 116 by way of coupling, and may be for example a piece of metal as shown in FIG. 1(A).

In one embodiment of the present invention, an air layer 132 exists between the first feed section 110 and the second feed section 112, i.e. the first feed section 110 and the second feed section 112 are spaced by a certain distance. In particular, the space between the feed sections 110 and 112 corresponds to that in the slot 130. The distance between the feed sections 110 and 112 may be modified in various ways and does not have to correspond to the width of the slot 130.

The first radiation element 114 is electrically connected to the first feed section 110, e.g. may be connected to the first feed section 110 in a direction perpendicular to the first feed section 110. The radiation element 114 may also be inclined from the perpendicular direction (which is parallel to the reflection plate 100) towards the reflection plate 100. In one embodiment of the present invention, the first base plate 118, the first feed section 110 and the first radiation element 114 may be formed by cutting from a single metal plate (e.g. aluminum). The base plate can then be bent so that it is perpendicular to the feed section 110.

The second radiation element 116 is electrically connected to the second feed section 112, e.g. may be connected to the second feed section 112 in a direction perpendicular to the second direction 112. In one embodiment of the present invention, the second base plate 120, the second feed section 112 and the second radiation element 116 may be formed by bending a piece of metal obtained by cutting a metal plate.

In one embodiment of the present invention, each of the radiation elements 114 and 116 is spaced by approximately λ/4 from an upper surface of the reflection plate 100.

The first base plate 118 supports the first feed section 110, and is a conductor.

The second base plate 120 supports the second feed section 112, and is a conductor.

In one embodiment of the present invention, each of the base plates 118 and 120 is spaced from the reflection plate 100 as shown in FIG. 1(C). In other words, an air layer exists between the base plates 118 and 120 and the reflection plate 100. Accordingly, each of the base plates 118 and 120 is capacitively joined to the reflection plate 100. Since the base plates 118 and 120 are spaced from the reflection plate 100, an extra supporting section may be used for supporting the radiator 102, although this is not shown in the drawings.

The feed track 104 is located on a backside of the reflection plate 100 as shown in FIG. 1(D), and may be realized with for example a microstrip line. That is, the feed track 104 may be made up of a dielectric layer and a conductive layer disposed in sequence on the reflection plate 100.

The feed track 104 extends up to the slot 130 as shown in FIG. 1(D). In a base station array antenna, the microstrip line would connect into the array distribution network. For a single radiator, the microstrip line may terminate in a coaxial connector to allow a source to be connected to the antenna.

In one embodiment of the present invention, a matching stub 142 may be connected to the feed track 104. The matching stub 142 has for example a length of approximately λ/4, and performs the function of impedance matching and maximizing the power coupled through the feed track 104 to the feed sections 110 and 112 through the slot 130. In other words, the matching stub 142 helps to maximize the power transfer to the feed sections 110 and 112 at the slot 130.

Hereinafter, a feeding process will be described in detail.

When power is supplied through the feed track 104, the slot 130 is excited, and so a field is formed at the slot 130. Subsequently, the field in the slot 130 excites directly the feeding sections 110 and 112 through the base plates 118 and 120. That is, the power of the feed track 104 is delivered to the feed sections 110 and 112 through the slot 130 and the base plates 118 and 120.

Then, the power of the feed sections 110 and 112 is fed to the radiation elements 114 and 116, and as a result, a certain radiation pattern is outputted from the radiator 102.

The feed sections 110 and 112, the base plates 118 and 120 and the slot 130 may be realized in various sizes considering impedance matching.

In brief, the antenna of the present invention feeds the power to the feed sections 110 and 112 by using the feed track 104 and the slot 130, and the radiator 102 is not physically connected to the reflection plate 100. Accordingly, passive intermodulation (PIMD) due to direct contact of metals is eliminated. As a result, since PIMD is avoided, the production yield of the antenna may be enhanced and the manufacturing cost of the antenna may be reduced.

In addition, since the base plate 118 or 120, the feed section 110 or 112 and the radiation element 114 or 116 are formed by bending a piece of metal, the radiator 102 may be easily manufactured and the manufacturing cost of the radiator 102 may be reduced. In a conventional dipole antenna, a feed line is connected to a balun section through soldering, and the radiator may need to be coated with a certain substance (e.g. tinning) so as to perform the soldering. However, the radiator 102 of the present invention does not require soldering, and thus no coating is required on the radiator 102. As a result, the manufacturing cost of the radiator 102 may be reduced.

In other words, the antenna of the present invention may be manufactured with low cost while providing high yield and excellent electrical characteristics. Additionally, the radiator 102 may be manufactured with low cost, and is not coated.

Additionally, shape and size of the radiation elements 114 and 116 may be modified in various ways in consideration of resonance frequency and design objective.

Figure 2:
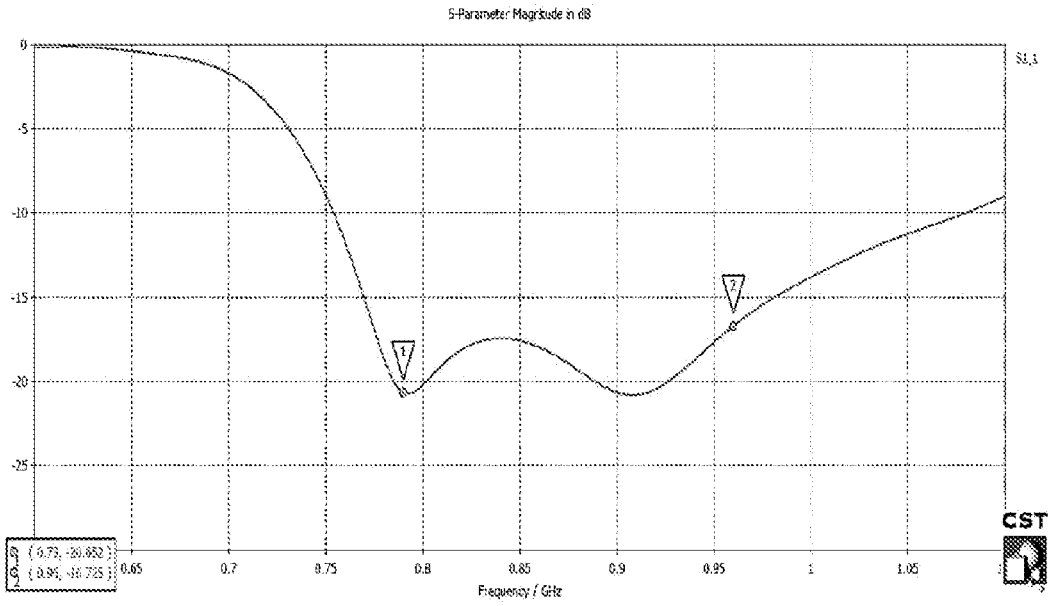
FIG. 2 and FIG. 3 are views illustrating electrical characteristics of the antenna in FIG. 1 according to one example embodiment of the present invention.
Figure 3:
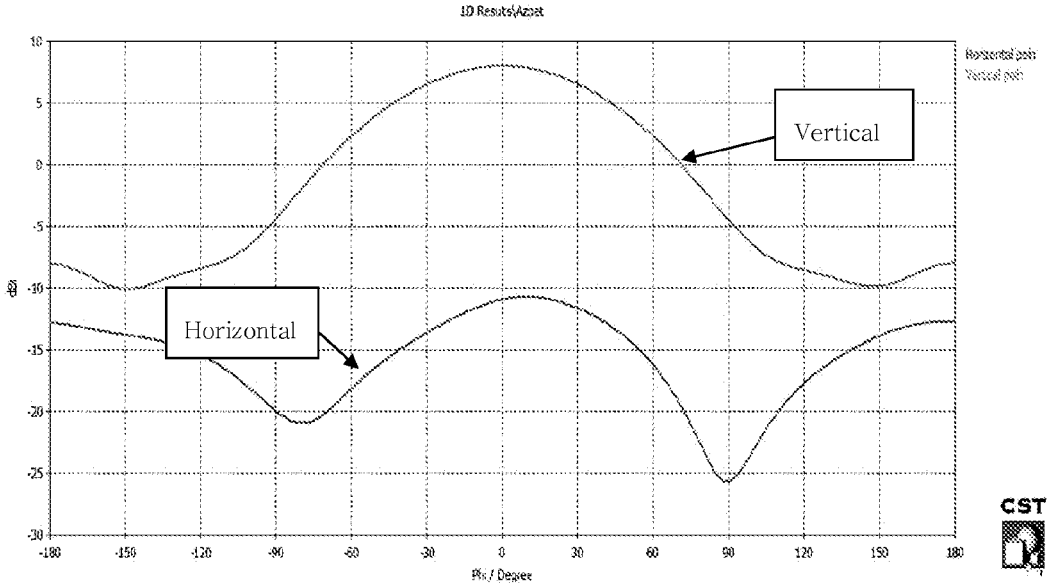

FIG. 2 and FIG. 3 are views illustrating electrical characteristics of the antenna in FIG. 1 according to one example embodiment of the present invention.

In FIG. 2, it is verified that the antenna of the present embodiment realizes the low frequency band of 790 MHz to 960 MHz and wide impedance matching is realized. In particular, the S11 in the band of 790 MHz to 960 MHz is no more than −16.7 dB, i.e. the antenna has excellent impedance matching characteristic.

In FIG. 3, the 3 dB beam width of an antenna that includes the radiator 102 in FIG. 1 is 85.5°, and the directivity of the antenna is 8 dBi.

Figure 4:
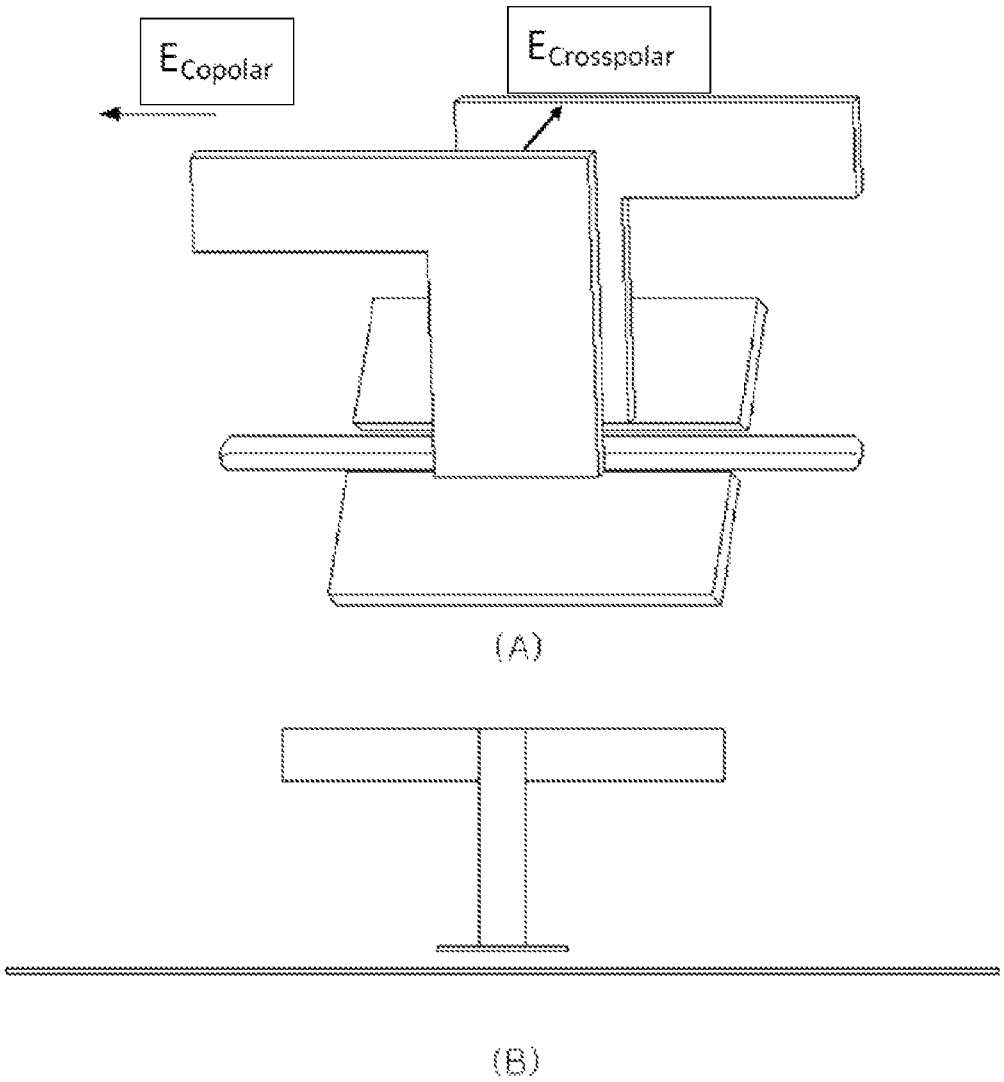
FIG. 4 is a view illustrating a radiator realizing high frequency band according to one example embodiment of the present invention.
Figure 5:
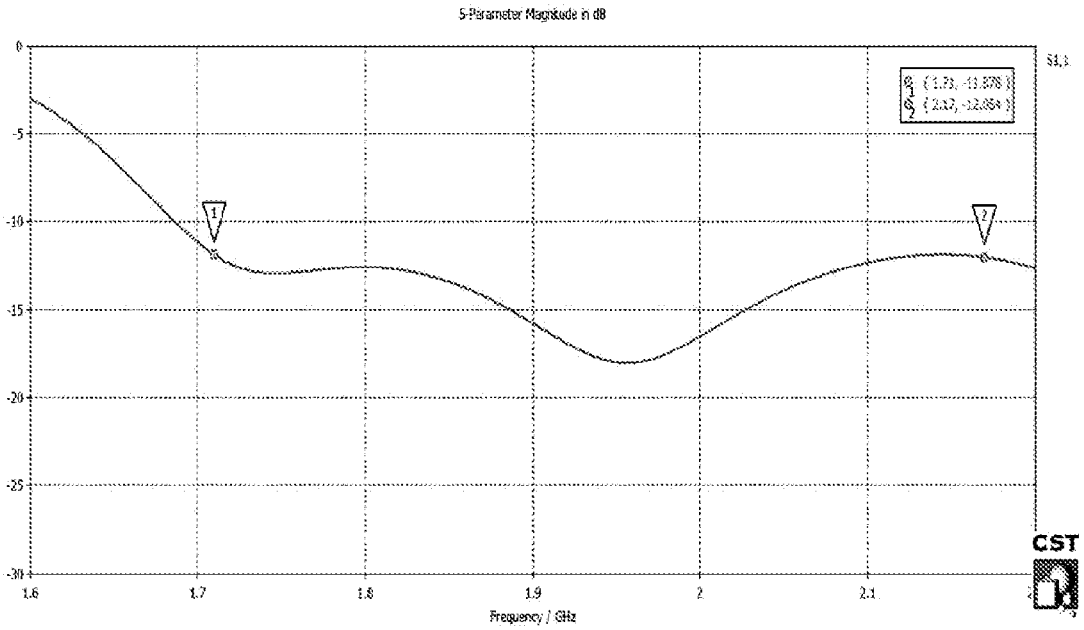
FIG. 5 and FIG. 6 are views illustrating electrical characteristics of the antenna in FIG. 4 according to one example embodiment of the present invention.
Figure 6:
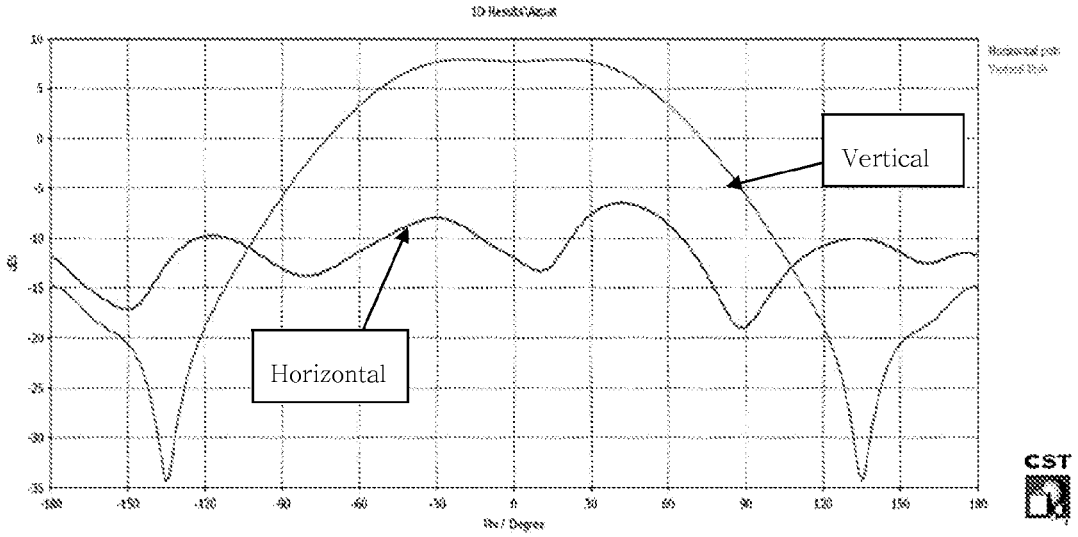

FIG. 4 is a view illustrating a radiator realizing high frequency band according to one example embodiment of the present invention. FIG. 5 and FIG. 6 are views illustrating electrical characteristics of the antenna in FIG. 4 according to one example embodiment of the present invention.

Referring to FIG. 4, an antenna of the present embodiment has the same structure as the antenna in FIG. 1, and realizes high frequency band compared with the antenna in FIG. 1. Here, the length (for example, approximately λ/4) of radiators is smaller than that of the radiators 114 and 116, but the width of a feed section is largely unchanged in order to maintain the characteristic impedance of the parallel strip transmission line.

In FIG. 5, it is verified that the antenna of the present embodiment realizes a high frequency band of 1710 MHz to 2170 MHz and wide impedance matching is realized. In particular, the S11 in the band of 1710 MHz to 2170 MHz is no more than −11.8 dB, i.e. the antenna has excellent impedance matching characteristics.

In FIG. 6, the 3 dB beam width of the antenna is 105.1°, and the directivity of the antenna is equal to 7.9 dBi.

It is verified that cross polarization of the antenna of the present embodiment is a little higher than that in FIG. 1. This is primarily due to radiation from the field excited in the parallel transmission line feed, which is perpendicular to the field radiated from the dipole itself. For the radiation pattern shown in FIG. 6 the dipole is vertical so that the dominant polarization is vertical. The field in the parallel strip transmission line feed is therefore horizontal, and this is the major source of the horizontally polarized cross-polar radiation in FIG. 6.

Figure 7:
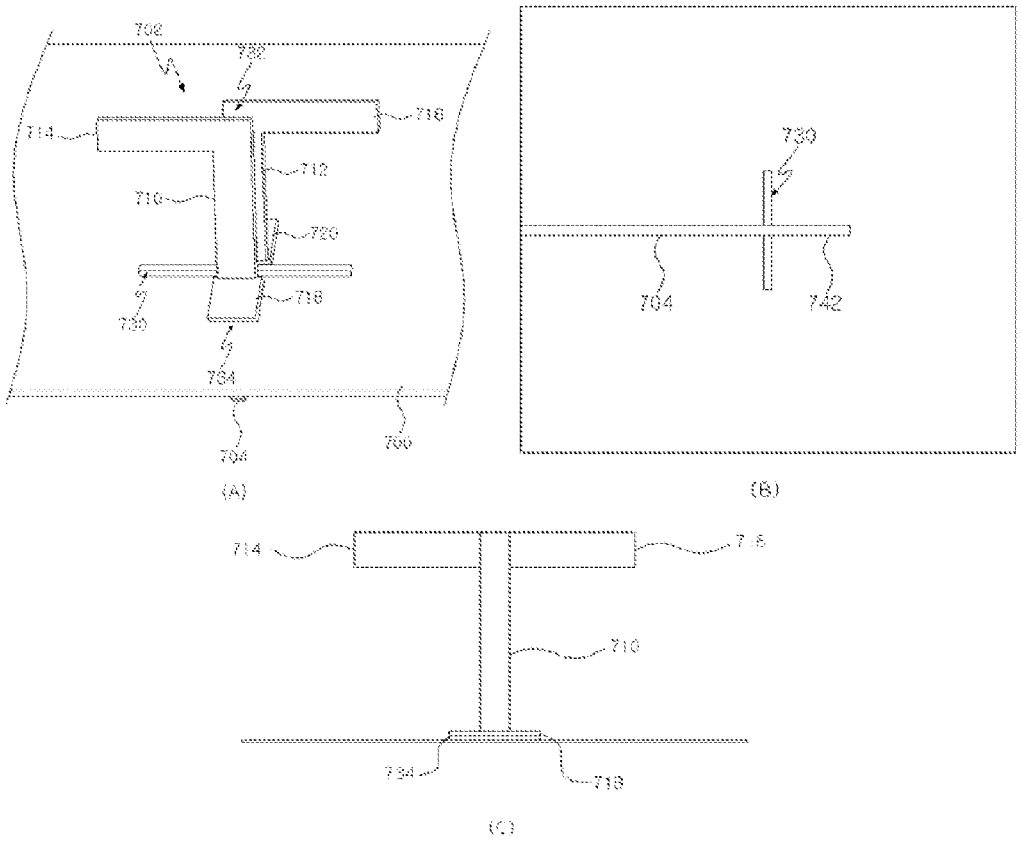
FIG. 7 is a perspective view illustrating an antenna according to a second embodiment of the present invention.

FIG. 7 is a perspective view illustrating an antenna according to a second embodiment of the present invention.

In FIG. 7(A) and FIG. 7(B), the antenna of the present embodiment includes a reflection plate 700, a radiator 702 and a feed track 704.

Since the elements other than the radiator 702 in the present embodiment are the same as those in the first embodiment, further descriptions concerning the same elements will be omitted.

The radiator 702 includes feed sections 710 and 712, radiation elements 714 and 716, base plates 718 and 720 and a supporting section 734.

The supporting section 734 supports the base plates 718 and 720 as shown in FIG. 7(C), preferably two divided sub-supporting sections support the base plates 718 and 710, respectively.

In one embodiment of the present invention, the supporting section 734 is made from a certain dielectric substance, e.g. Poly Tetra Fluoro Ethylene (PTFE) spacer. Here, the size of the base plates 718 and 720 when the supporting section 734 is disposed between the base plates 718 and 720 and the reflection plate 700 is smaller than that of the base plates 118 and 120 when the air layer is disposed between the base plates 118 and 120 and the reflection plate 100. This is because the capacitance between the base plates 718 and 720 and the reflection plate 700 is increased due to the dielectric constant of the supporting section 734 being higher than that of the air layer.

In short, the antenna of the present embodiment supports the base plates 718 and 720 using the supporting section 734 so as to secure the radiator 702 on the reflection plate 700 in a stable manner. The present invention uses a coupling feeding method through the slot (aperture) 730 as in the first embodiment.

Figure 8:
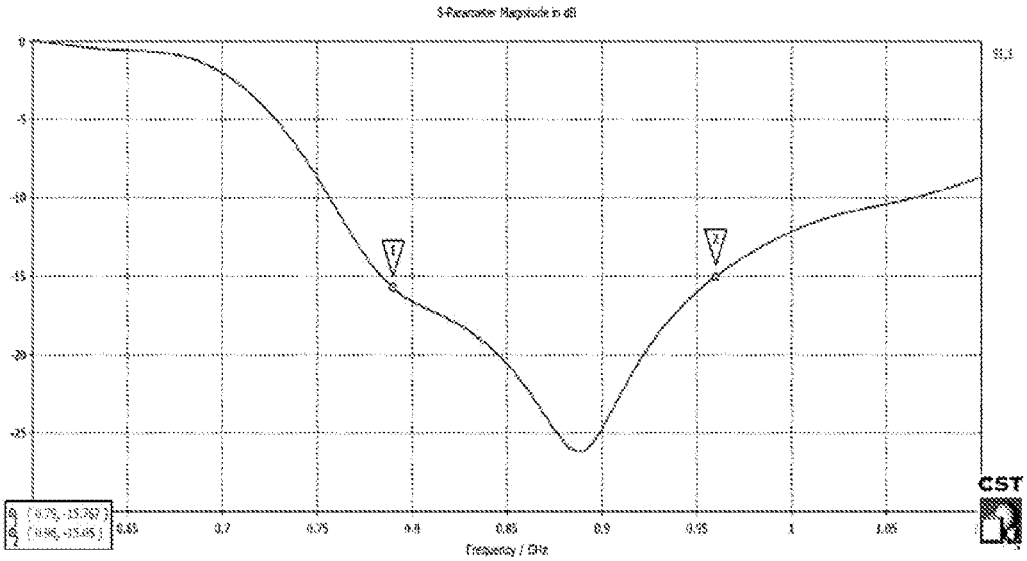
FIG. 8 and FIG. 9 are views illustrating electrical characteristics of the antenna in FIG. 7 according to one example embodiment of the present invention.
Figure 9:
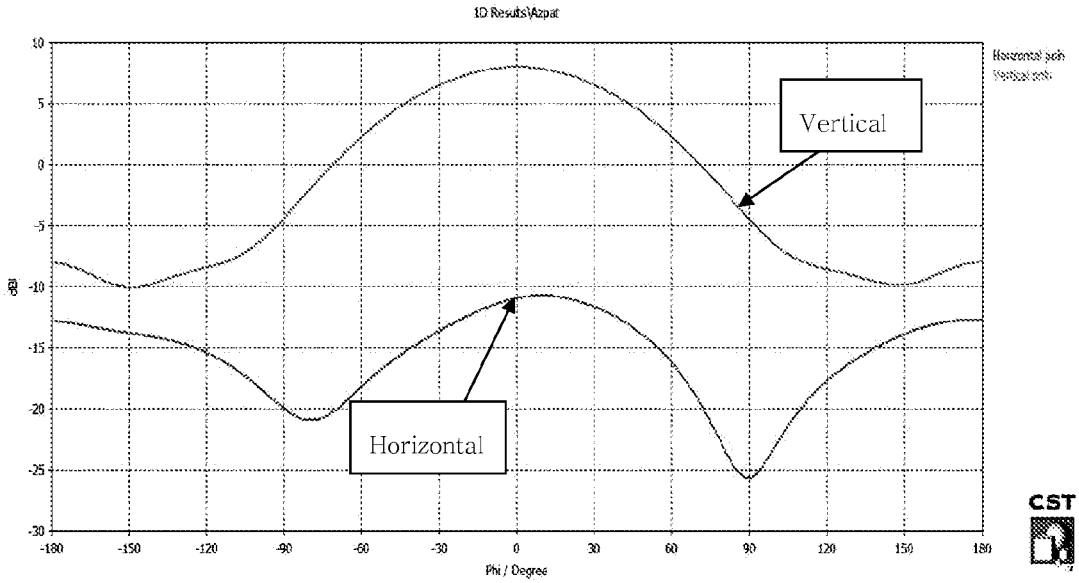

FIG. 8 and FIG. 9 are views illustrating electrical characteristics of the antenna in FIG. 7 according to one example embodiment of the present invention.

In FIG. 8, it is verified that the antenna of the present embodiment realizes a low frequency band of 790 MHz to 960 MHz like the first embodiment and wide impedance matching is realized. In particular, the S11 in the band of 790 MHz to 960 MHz is no more than −15 dB, i.e. the antenna has excellent impedance matching characteristic.

In FIG. 9, the 3 dB beam width of the antenna is 85.5°, and the directivity of the antenna is 8 dBi.

Figure 10:
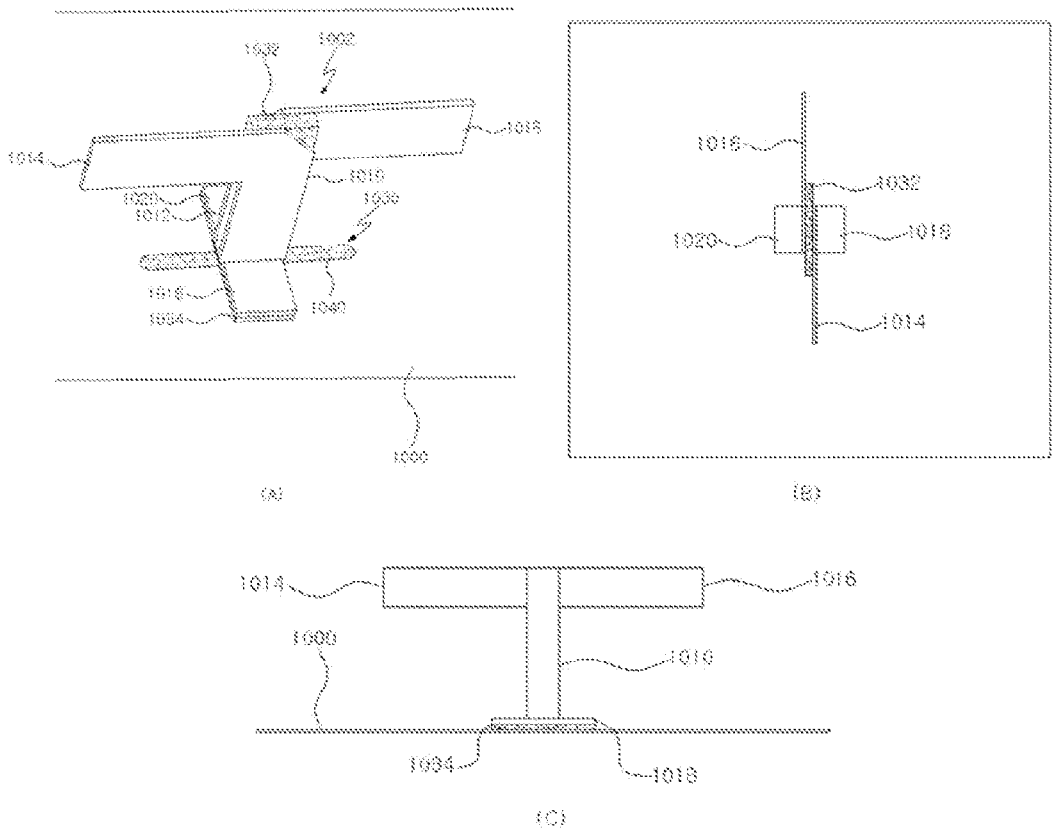
FIG. 10 is a perspective view illustrating an antenna according to a third embodiment of the present invention.

FIG. 10 is a perspective view illustrating an antenna according to a third embodiment of the present invention.

In FIG. 10(A) and FIG. 10(B), the antenna of the present embodiment includes a reflection plate 1000, a radiator 1002 and a feed track. Since structure of the backside of the reflection plate 1000 including the feed track is the same as in the first embodiment, the structure of the backside is not shown.

The radiator 1002 includes a first feed section 1010, a second feed section 1012, a first radiation element 1014, a second radiation element 1016, a first base plate 1018 and a second base plate 1020.

In one embodiment of the present invention, a supporting section 1034 may be disposed between the base plates 1018 and 1020 and the reflection plate 1000 as shown in FIG. 10(C), i.e. the supporting section 1034 supports the base plates 1018 and 1020. Here, the supporting section 1034 may be made from a PTFE dielectric substance.

In another embodiment of the present invention, a dielectric layer 1032 and not an air layer may be formed between the feed sections 1010 and 1012. It is desirable that the dielectric layer 1032 be filled wholly between the feed sections 1010 and 1012.

In still another embodiment of the present invention, a dielectric layer 1040 having a certain dielectric constant may be formed in the slot 1030 on the reflection plate 1000, i.e. dielectric substance is filled in the slot 1030.

In brief, unlike the air layers formed between the feed section 110 and 112, in the slot 130 and between the base plates 118 and 120 and the reflection plate 100, dielectric layers are disposed between the feed section 1110 and 1112, in the slot 1130 and between the base plates 1118 and 1120 and the reflection plate 1000 in the present embodiment. Here, the dielectric layers disposed between the feed section 1110 and 1112, in the slot 1130 and between the base plates 1118 and 1120 and the reflection plate 1000 may be made from the same dielectric substance, e.g. a PTFE dielectric substance, but also may be made from another dielectric substance.

The use of a dielectric in the parallel strip transmission line formed by 1010 and 1012 means that the width can be decreased compared to the case where an air spacing is used to achieve the same impedance characteristics. Decreasing the width of the transmission line feed means that the element can be used over a larger frequency range.

Figure 11:
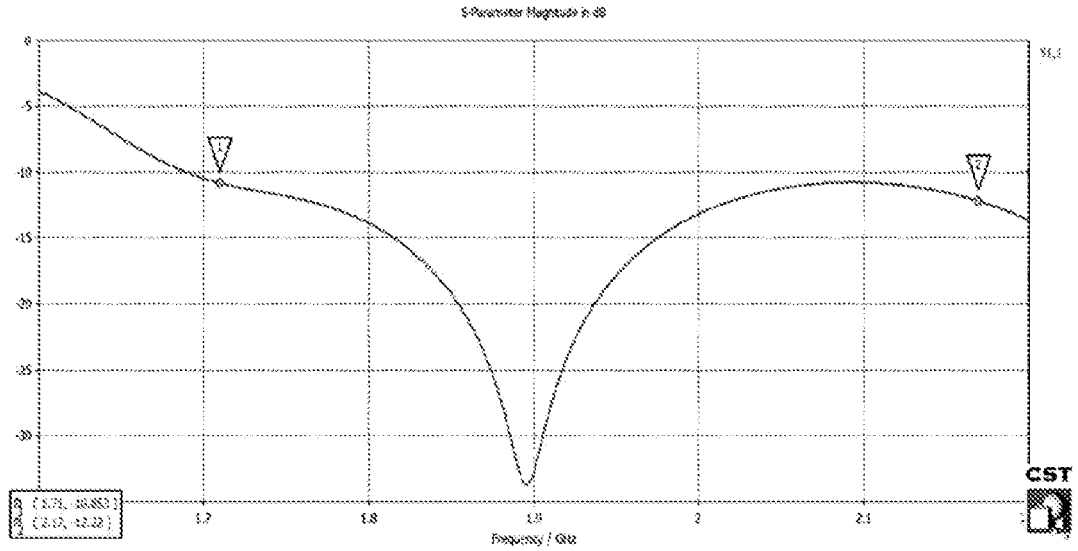
FIG. 11 and FIG. 12 are views illustrating electrical characteristics of the antenna in FIG. 10 according to one example embodiment of the present invention.
Figure 12:
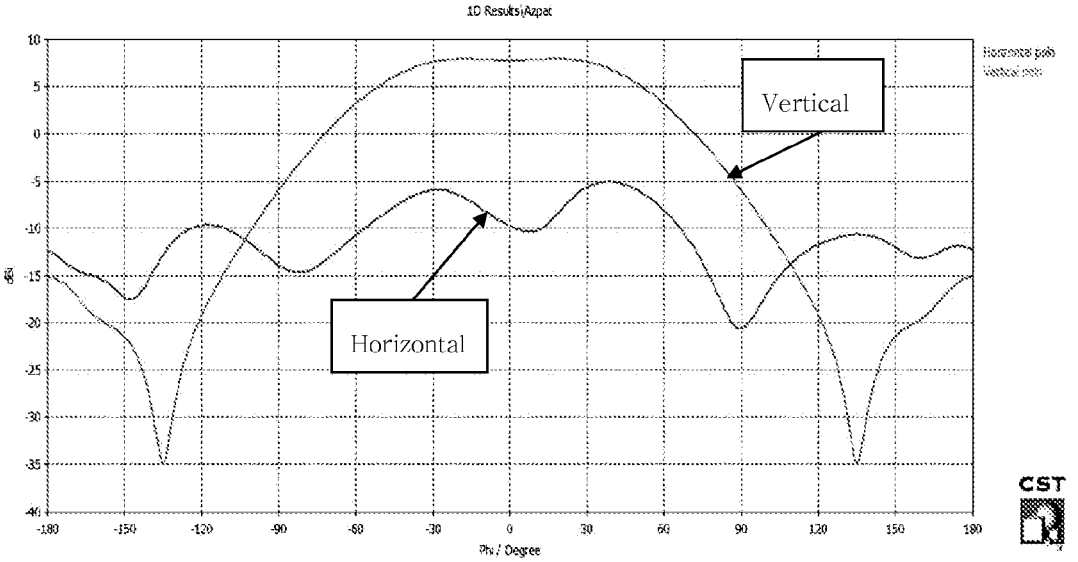

FIG. 11 and FIG. 12 are views illustrating electrical characteristics of the antenna in FIG. 10 according to one example embodiment of the present invention.

In FIG. 11, it is verified that the antenna of the present embodiment realizes a high frequency band of 1710 MHz to 2170 MHz and wide impedance matching is realized. The S11 in the band of 1710 MHz to 2170 MHz is no more than −10 dB, i.e. the antenna has excellent impedance matching characteristic. In particular, the impedance matching is excellent in the present embodiment.

In FIG. 12, the 3 dB beam width of the antenna is 103.6°, and the directivity of the antenna is 7.9 dBi. It is verified that cross polarization in the present embodiment is considerably higher than that in the first embodiment, due to cross-polar radiation from the end of the transmission line feed.

Figure 13:
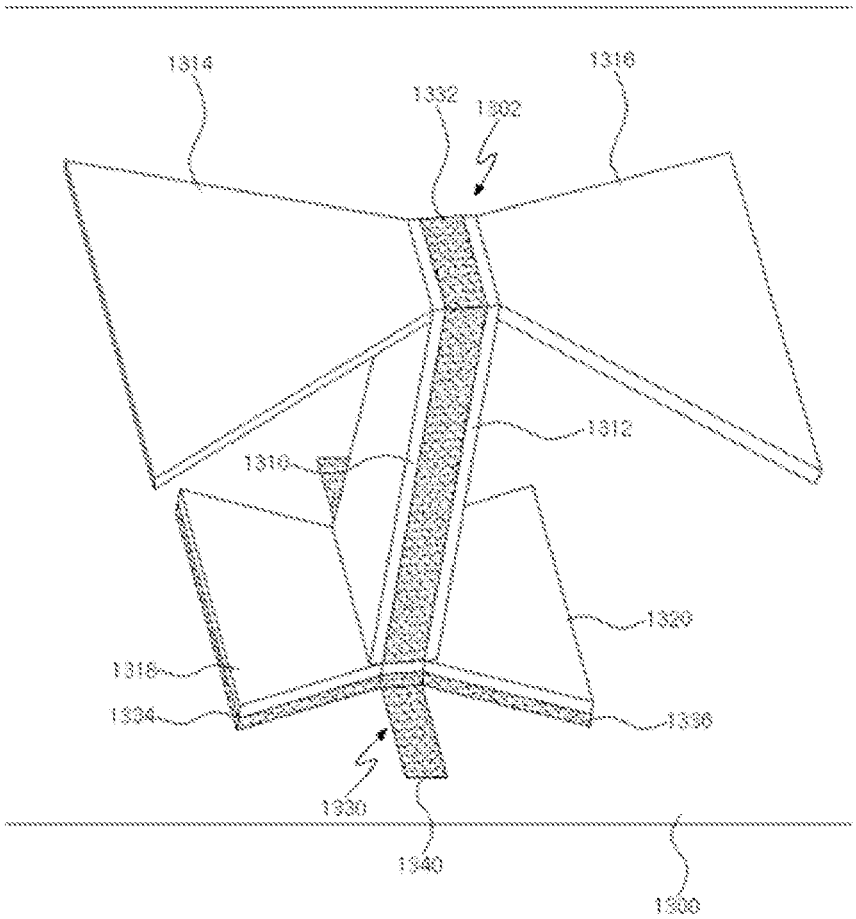
FIG. 13 is a perspective view illustrating an antenna according to a fourth embodiment of the present invention.
Figure 13:
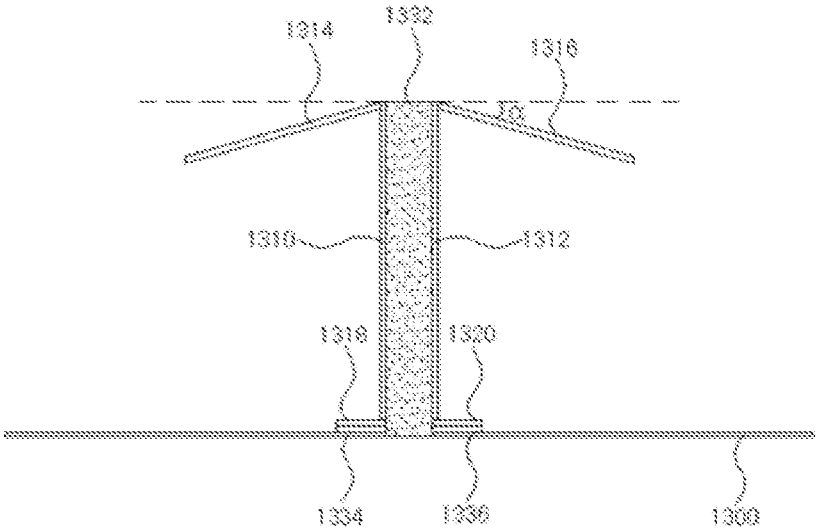

FIG. 13 is a perspective view illustrating an antenna according to a fourth embodiment of the present invention.

In FIG. 13(A), the antenna of the present embodiment includes a reflection plate 1300, a radiator 1302 and a feed track. Since the structure of backside of the reflection plate 1300 including the feed track is the same as in the first embodiment, further descriptions concerning the structure of backside of the reflection plate 1300 will be omitted.

The radiator 1302 has a structure capable of reducing cross polarized radiation, and includes feed sections 1310 and 1312, radiation elements 1314 and 1316, base plates 1318 and 1320 and supporting sections 1334 and 1336.

A dielectric layer 1332 made from a certain dielectric substance is disposed between the feed sections 1310 and 1312.

The first radiation element 1314 is bent to an angle of approximately ninety degrees or greater with respect to the feed section 1310, as shown in FIG. 13(B). In one embodiment of the present invention, the first radiation element 1314 may have a varying width from the feed section to its extremity, where this may be linearly varying, or it may follow some other profile. In addition, it may be slanting by an angle of a in a direction to the reflection plate 1300 from a horizontal plane as shown in FIG. 13(B).

The second radiation element 1316 is extended from the second feed section 1312 and is bent in a similar fashion to the first radiation element 1314. In one embodiment of the present invention, the second radiation element 1316 may have a width that varies from the feed section to its extremity, where this may be varying linearly, or it may follow some other profile. In addition, it may be slanting by an angle of a in a direction to the reflection plate 1300 as shown in FIG. 13(B). The slope of the second radiation element 1316 may be identical to that of the first radiation element 1314, or may be different from that of the first radiation element 1314.

In one embodiment, the radiation elements 1314 and 1316 have a butterfly shape, and are slanting in a direction to the reflection plate 1300, as shown in FIG. 13.

In another embodiment of the present invention, each of the radiation elements 1314 and 1316 may have a shape other than triangular.

The base plate 1318 or 1320 is connected to the end of the corresponding feed section 1310 or 1312, and is capacitively joined to the reflection plate 1300 by way of coupling.

In one embodiment of the present invention, the base plates 1318 and 1320 may have a butterfly shape like the radiation elements 1314 and 1316, and a taper is added to the base plate 1318 or 1320. This is for enhancing the impedance matching characteristics. That is, to enhance the impedance matching characteristics, the radiation elements 1314 and 1316 have a butterfly shape, and the base plate 1318 or 1320 is tapered.

The size of the base plate 1318 or 1320 may be smaller than that of the radiation element 1314 or 1316.

Looking at the manufacture of a radiator 1302 having this structure, the feed section 1310 or 1312, the corresponding radiation element 1314 or 1316 and the base plate 1318 or 1320 may be manufactured by twice bending a single piece of metal. In other words, the radiator 1302 has a simple structure as in the first embodiment, and may be manufactured with low cost. Furthermore, since the radiator 1302 is not contacted physically to the reflection plate 1300 or the feed track, PIMD can be eliminated.

In one embodiment of the present invention, the supporting section 1334 or 1336 made of a dielectric substance is disposed between the base plate 1318 or 1320 and the reflection plate 1300.

In another embodiment of the present invention, a dielectric substance is filled in the slot 1330 on the reflection plate 1300, i.e. a dielectric layer 1340 is formed in the slot 1330.

In short, the radiator 1302 of the present embodiment includes the radiation elements 1314 and 1316 and the base plates 1318 and 1320 having a butterfly shape.

In another embodiment of the present invention, an air layer instead of the dielectric layer may be formed between the feed sections 1310 and 1312, between the base plates 1318 and 1320 and the reflection plate 1300 and in the slot 1330.

Figure 14:
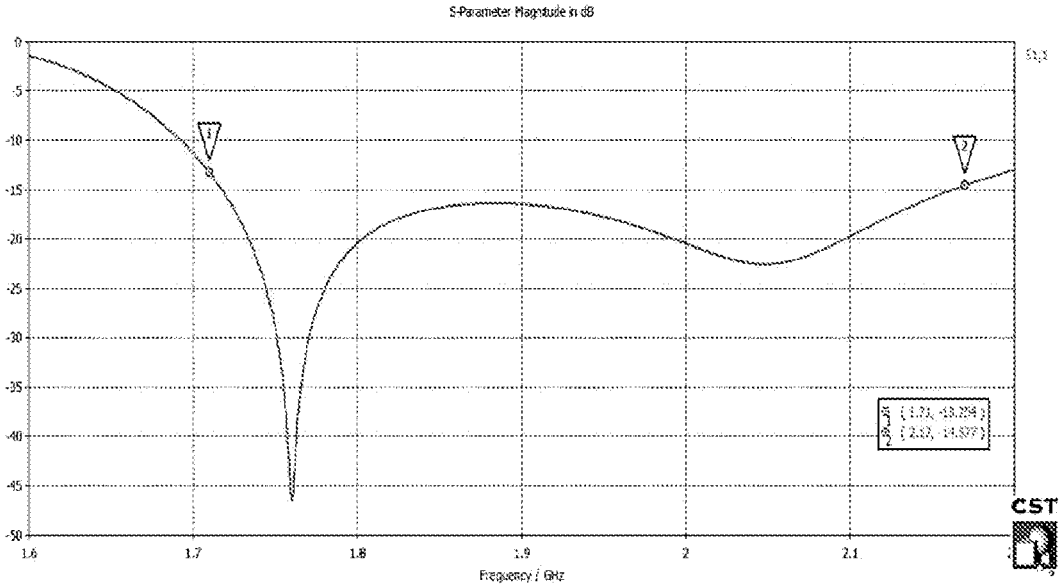
FIG. 14 and FIG. 15 are views illustrating electrical characteristics of the antenna in FIG. 13 according to one example embodiment of the present invention.
Figure 15:
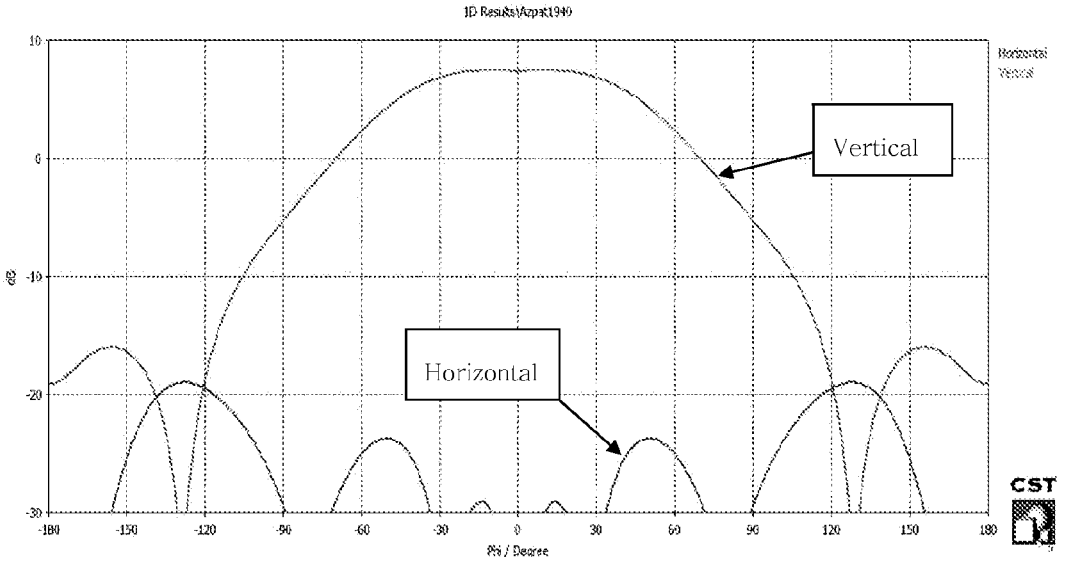

FIG. 14 and FIG. 15 are views illustrating electrical characteristics of the antenna in FIG. 13 according to one example embodiment of the present invention.

In FIG. 14, it is verified that the antenna of the present embodiment realizes a high frequency band of 1710 MHz to 2170 MHz and wide impedance matching is realized. The S11 in the band of 1710 MHz to 2170 MHz is no more than −13 dB, i.e. the antenna has excellent impedance matching characteristics.

In FIG. 15, it is verified that level of cross polarization is reduced when the field of the radiator 1302 and the field in the slot 1330 are aligned.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An antenna comprising:

a reflection plate; and a radiator, wherein the radiator includes:

feed sections disposed on a first surface of the reflection plate;

first and second radiation elements extending from the feed sections parallel to the reflection plate, or inclined towards the reflection plate; and first and second base plates configured to support the feed sections, and wherein the first and second base plates are capacitively coupled to the reflection plate;

wherein an air layer or a first dielectric substance is formed between the feed sections, an air layer or a second dielectric substance is formed between the base plates and the reflection plate, and an air layer or a third dielectric substance is formed in a slot of the reflection plate.

2. The antenna of claim 1, the antenna further includes a feed track disposed on a second surface opposed to the first surface from among surfaces of the reflection plate, and a matching stub longitudinally extends from the feed track, wherein the feed track extends up to a slot, formed in a surface of the reflection plate a field is formed in the slot when power is supplied to the feed track, and the field in the slot feeds power to the radiation elements through the base plates and the feed sections.

3. The antenna of claim 1, wherein the radiation elements have varying widths from the feed section to their extremity, and the base plates have varying widths from the feed section to their extremity, and wherein the radiation elements are slanting by a certain angle in a direction to the reflection plate from a horizontal plane of the feed section, and the first base plate, a first feed section of the feed sections and the first radiation element are manufactured by bending a single piece of metal, and the second base plate, a second feed section of the feed sections and the second radiation element are manufactured by bending a single piece of metal.

4. The antenna of claim 1, wherein the radiation elements are spaced by $\lambda/4$ from the reflection plate, and $\lambda$ means a wavelength of a centre frequency of a beam radiated from the antenna.

5. An antenna comprising:

a reflection plate;

a radiator disposed on a first surface of the reflection plate; and a feed track disposed on a second surface opposed to the first surface from among surfaces of the reflection plate, wherein the radiator includes:

feed sections disposed on the first surface of the reflection plate; and first and second base plates configured to support the feed sections; and first and second radiation elements extending from the feed sections parallel to the reflection plate, or inclined towards the reflection plate, and wherein a slot is formed in a surface of the reflection plate, and power supplied through the feed track is fed to the radiation elements through the slot in the reflection plate.

6. The antenna of claim 5, wherein the feed track extends up to the slot, the antenna further includes a matching stub longitudinally extending from the feed track, a field is formed in the slot when power is supplied to the feed track, and the field in the slot feeds power to the radiation elements through the base plates and the feed sections.

7. The antenna of claim 5, wherein an air layer or a first dielectric substance is formed between the feed sections, an air layer or a second dielectric substance is formed between the base plates and the reflection plate, and an air layer or a third dielectric substance is formed in a slot of the reflection plate.

8. The antenna of claim 5, wherein the radiation elements have varying width from the feed section to their extremity, and the base plates have varying width from the feed section to their extremity, and wherein the radiation elements are slanting by a certain angle in a direction to the reflection plate from horizontal plane of the feed section, and the first base plate, a first feed section of the feed sections and the first radiation element are manufactured by bending a single piece of metal, and the second base plate, a second feed section of the feed sections and the second radiation element are manufactured by bending a single piece of metal.

9. The antenna of claim 5, wherein the first radiation element is spaced by $\lambda/4$ from the reflection plate, and $\lambda$ means a wavelength of a centre frequency of a beam transmitted from the antenna.

10. The antenna of claim 5, wherein the first base plate, a first feed section of the feed sections and the first radiation element are manufactured by bending a single piece of metal, and the second base plate, a second feed section of the feed sections and the second radiation element are manufactured by bending a single piece of metal.

11. An antenna comprising:

a reflection plate; and a radiator disposed on a first surface of the reflection plate, wherein the radiator includes:

balanced parallel strip feed sections disposed on the first surface of the reflection plate;

first and second base plates configured to support the balanced parallel strip feed sections; and first and second radiation elements extending from the feed sections parallel to the reflection plate, or inclined towards the reflection plate, and wherein the first and second radiation elements are spaced by $\lambda/4$ from the reflection plate, and $\lambda$ means a wavelength of a centre frequency of a beam radiated from the antenna;

wherein the radiation elements have varying width from the feed sections to their extremities, and the base plates have varying width from the feed sections to their extremities, and wherein the radiation elements are slanting by a certain angle in a direction to the reflection plate from horizontal plane of the feed sections.

12. The antenna of claim 11, wherein the antenna further includes a feed track having microstrip structure and disposed on a second surface opposed to the first surface of surface of the reflection plate, and wherein a slot is formed on the reflection plate, and power supplied through the feed track is fed to the first and second radiation elements through the slot.

13. The antenna of claim 11, wherein the base plates are capacitively coupled to the reflection plate, and the first base plate, a first feed section of the feed sections and the first radiation element are manufactured by bending a single piece of metal, and the second base plate, a second feed section of the feed sections and the second radiation element are manufactured by bending a single piece of metal.

14. The antenna of claim 13, wherein an air layer exists between the feed sections or first dielectric substance is filled between the feed sections, an air layer exists between the base plates and the reflection plate second dielectric substance is filled between the base plates, and an air layer exists in a slot of the reflection plate or third dielectric substance is filled in the slot.

15. A radiator disposed on a reflection plate in an antenna, the radiator comprising:

balanced parallel strip feed sections disposed on a first surface of the reflection plate;

first and second radiation elements extending from the feed sections parallel to the reflection plate, or inclined towards the reflection plate; and first and second base plates configured to support the balanced parallel strip feed sections, wherein the first and second base plates are capacitively coupled to the reflection plate;

wherein the radiation elements have varying width from the feed sections to their extremities, and the base plates have varying width from the base plates to their extremities, and wherein the radiation elements are slanting by a certain angle in a direction to the reflection plate from the horizontal plane of the feed sections, and the first base plate, a first feed section and the first radiation element are manufactured by bending a single piece of metal, and the second base plate, a second feed section and the second radiation element are manufactured by bending a single piece of metal.

16. The radiator of claim 15, wherein an air layer exists between the feed sections or first dielectric substance is filled between the feed sections, an air layer exists between the base plates and the reflection plate second dielectric substance is filled between the base plates, and an air layer exists in a slot of the reflection plate or third dielectric substance is filled in the slot.

17. The radiator of claim 15, wherein the first and second radiation elements are spaced by $\lambda/4$ from the reflection plate, and $\lambda$ means a wavelength of a centre frequency of a beam radiated from the antenna.

18. A radiator disposed on a reflection plate in an antenna, the radiator comprising:

feed sections disposed on a first surface of the reflection plate;

first and second radiation elements extending from the feed section parallel to the reflection plate, or inclined towards the reflection plate; and first and second base plates configured to support the feed sections, wherein the first base plate, a first feed section of the feed sections and the first radiation element are manufactured by bending a single piece of metal, and the second base plate, a second feed section of the feed sections and the second radiation element are manufactured by bending a single piece of metal, and wherein a slot is formed in the reflection plate, and power supplied from the feed track is fed to the radiation elements through the slot, the base plates and the feed sections.

19. The radiator of claim 18, wherein the first and second base plates are capacitively coupled to the reflection plate, and the first base plate, the first feed section and the first radiation element are manufactured by twice bending a single piece of metal, and the second base plate, the second feed section and the second radiation element are manufactured by twice bending a single piece of metal.

20. The radiator of claim 18, wherein an air layer or a first dielectric substance is formed between the feed sections, an air layer or a second dielectric substance is formed between the base plates and the reflection plate, and an air layer or a third dielectric substance is formed in a slot of the reflection plate.

21. The radiator of claim 18, wherein the radiation elements have varying width from the feed section to their extremities, and the base plates have varying width from the feed section to their extremities, and wherein the radiation elements are slanting by a certain angle in a direction to the reflection plate from the horizontal plane of the feed section.

22. The radiator of claim 18, wherein the first and second radiation elements are spaced by $\lambda/4$ from the reflection plate, and $\lambda$ means a wavelength of a centre frequency of a beam radiated from the antenna.

* * * * *